US005243843A

United States Patent [19]

Dickson

[11] Patent Number: 5,243,843

[45] Date of Patent: * Sep. 14, 1993

[54] THREAD FORMING METHOD AND APPARATUS

[75] Inventor: Joseph F. Dickson, Jefferson, Mass.

[73] Assignee: Quamco, Inc., Holden, Mass.

[ * ] Notice: The portion of the term of this patent subsequent to Feb. 2, 2010 has been disclaimed.

[21] Appl. No.: 817,590

[22] Filed: Jan. 7, 1992

Related U.S. Application Data

[63] Continuation-in-part of Ser. No. 761,413, Sep. 17, 1991, Pat. No. 5,182,937.

[51] Int. Cl.[5] ..... B21H 3/06

[52] U.S. Cl. ..... 72/88; 72/469; 72/103

[58] Field of Search ..... 72/469, 88, 90, 103, 72/92, 93

[56] References Cited

U.S. PATENT DOCUMENTS 618,262 1/1899 Ames ..... 72/469
3,204,442 9/1965 Wieber ..... 72/469
4,065,948 1/1978 Tsukamoto ..... 72/469
4,862,718 9/1989 La Croix ..... 72/88

FOREIGN PATENT DOCUMENTS 856634 8/1981 U.S.S.R. ..... 72/103
2063740 6/1981 United Kingdom ..... 72/90

*Primary Examiner*—Daniel C. Crane
*Attorney, Agent, or Firm*—Chilton, Alix & Van Kirk

[57] ABSTRACT

A method of producing threaded fasteners, particularly screws characterized by a thread root which is substantially wider than the thread crest, which results in seam free threads. The method employs a rolling die with a novel double form thread profile geometry wherein the angle of divergence of the groove defining walls gradually varies between an obtuse pointing angle and an acute finish angle as the groove depth increases from a sorting depth to the finish depth. The finish form of the die is maintained for a length which is commensurate with at least two and one-half revolutions of the fastener which is being formed.

15 Claims, 4 Drawing Sheets

THREAD FORMING METHOD AND APPARATUS

CROSS REFERENCE TO RELATED APPLICATION

This application is a continuation-in-part of co-pending application Ser. No. 761,413 filed Sep. 17, 1991, now U.S. Pat. No. 5,182,937, issued Feb. 2, 1993.

BACKGROUND OF THE INVENTION

1. Field of the Invention.

The present invention relates to thread forming dies and particularly to rolling dies having a unique thread profile geometry which will produce a seam-free space type thread. More specifically, this invention is directed to the production of seam-free threaded fasteners and particularly to the generation of rolled form threads characterized by a root which is wider than the thread crest and by an absence of seams, laps and craters. Accordingly, the general objects of the present invention are to provide novel and improved methods and apparatus of such character.

2. Description of the Prior Art.

As pointed out in the above-referenced co-pending application, which is hereby incorporated herein by reference, the formation of a threaded fastener by subjecting a generally cylindrically-shaped portion of a preformed metal blank to a thread-rolling process is well known. The co-pending application discloses and claims a novel technique, and rolling dies for use in the practice of such technique, for forming machine-type screws wherein the thread is free of fissures at the crest of the thread. A machine screw is generally characterized by a helical thread having a crest width which is substantially equal to the root width and in the technique of the co-pending application the profile of the thread forming die is generated about the pitch line of the thread.

The desirability, and thus potential marketability, of a machine screw characterized by the absence of crest seams has precipitated a desire to extend the technology of the referenced co-pending application to the manufacture of threaded fasteners characterized by what is known in the art as "space type threads". A "space type thread" is characterized by a coarse pitch and a root which is wider than the thread crest. Fasteners having a "space type thread" include type B, type AB, type A, wood screws and lag screws along with the customized variations of such fasteners.

SUMMARY OF THE INVENTION

The present invention resides, in part, in a novel die thread profile geometry which enables the mass-production of seam-free space type threads. The present invention also encompasses a unique process for the generation of fasteners having space type threads and particularly to a process wherein the fastener blank is worked in such a manner that the formation of seams, laps and craters is avoided during the pressure induced flow of metal to define the thread.

A thread-rolling die in accordance with the present invention is characterized by a thread profile geometry which is generated about the diameter of the blank in which the thread is to be formed. This thread profile geometry, at its starting end, has a groove depth which equals approximately twice the penetration. As used herein, and as understood in the fastener industry, penetration is one-half the difference between eh diameter of the blank and the diameter of the root of the screw to be formed. In the case of a space type thread, due to the unbalanced thread profile which is characterized by a wide crest flat and a reactively narrow root flat on the die, the groove depth at the finish end of the die does not equal or approximate twice the penetration. The starting end groove depth will gradually increase to the finish form depth. The finish form depth extends, from the finish or discharge end of the die toward the starting end of the die, a length which is equivalent to at least 2.5 screw revolutions. This finish form length or dwell region, in the typical case, will be approximately one-third of the die length. The thread profile geometry of a thread rolling die in accordance with the invention is also characterized by an obtuse pointing angle, i.e., the angle of intersection of a pair of facing sidewalls or flanks which define the starting end of a groove, which changes as a function of both thread diameter and pitch. The die profile undergoes a smooth transition to the finish form, as the thread depth increases, from the starting end of the die to the beginning of the dwell region where the finish form depth is achieved. The thread profile geometry will have a double form during this transition, i.e., the transition will progress outwardly toward the crest as the pointed thread form evolves to the acute angle of the finish form and the thread depth increases. Thus, the pointing form angle at the starting end of the die will gradually fade out between the starting end of the die and the start of the die dwell region.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several Figures and in which.

DESCRIPTION OF THE DISCLOSED EMBODIMENT

Figure 1:
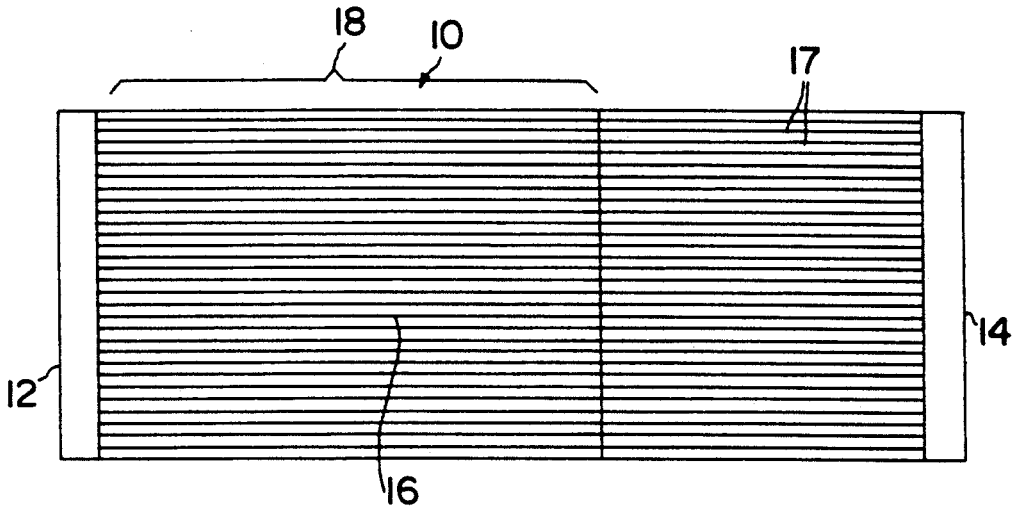
FIG. 1 is a top view of one of a pair of cooperating flat thread rolling dies in accordance with the invention, the other die appearing substantially the same when similarly viewed.
Figure 2:
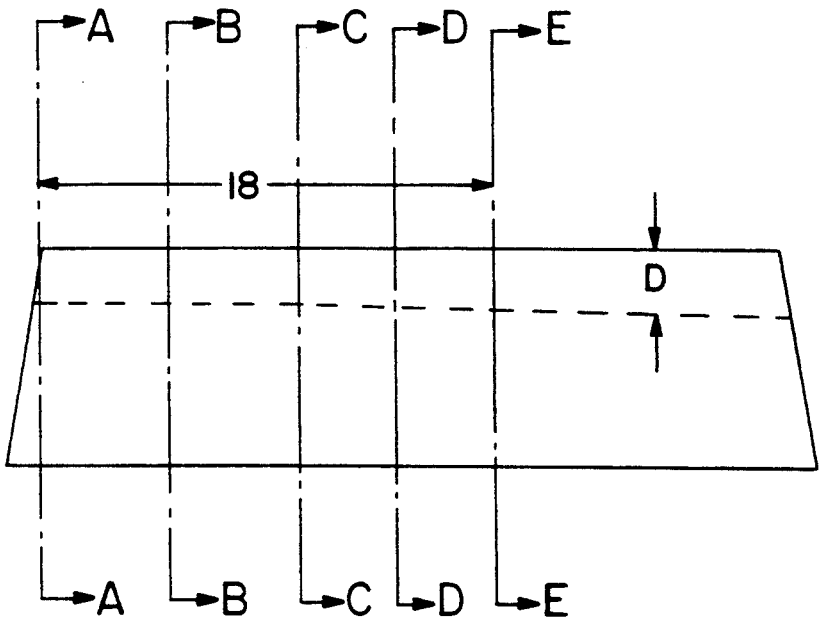
FIG. 2 is a side elevation view of the die of FIG. 1, the cooperating die appearing substantially the same when similarly viewed.

With reference now to the drawings, a "flat" thread-rolling die in accordance with the invention is shown, respectively in top and side views, in FIGS. 1 and 2. FIGS. 1 and 2 may be considered as showing either the stationary or "short" die or the reciprocating or "long" die of a pair of cooperating flat dies. The die of FIGS. 1 and 2 is intended for manufacture of a fastener having a space type thread, a type B self-tapping screw for example, having a 60° finish form. The die, which is indicated generally at 10, has a starting end 12 and a finish end 14. The face 16 of the die is machined so as to have parallel lands and grooves 17 shaped in accordance with a thread-forming profile.

As a cylindrical fastener blank is caused to roll from the starting end to the finish end of the dies, such rolling being a result of imparting motion to the "long" die while holding the "short" die stationary, the blank will be subjected to compression. Accordingly, the material comprising the blank will flow to define the thread, such flow being controlled by the shape or profile of the grooves 17. The die 10, with the exception of the unique thread profile geometry to be described below, is of conventional construction.

Figure 3:
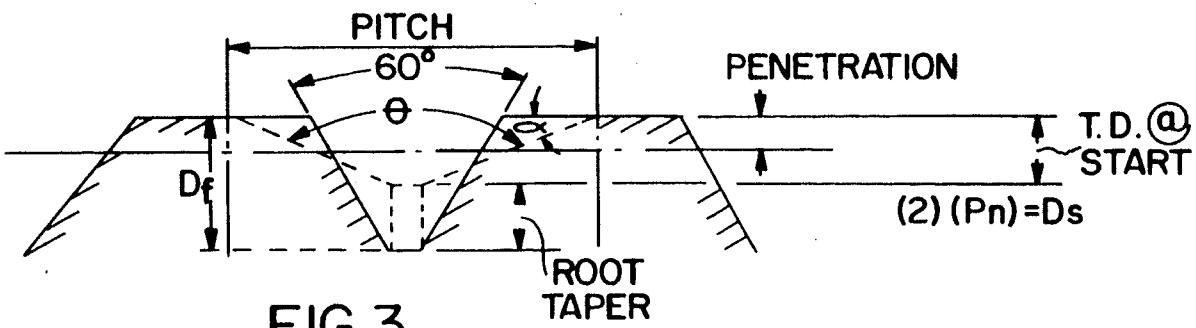
FIG. 3 is an engineering drawing which will enable a designer to provide a thread rolling die in accordance with the invention.

FIG. 3 is an engineering drawing relating to die 10. FIG. 3 shows the parameters which must be taken into account in calculating the die profile geometry which will permit production of a seam-free space type thread. In FIG. 3, the solid lines represent the thread form at the finish end of the "short" or stationary die and the matching point on the "long" or moving die. The broken line showing indicates the thread form at the starting end of the dies. Referring to FIG. 3, the amount that the blank penetrates into the die, is calculated as follows:

$$\text{Penetration } (Pn) = \frac{\text{Blank Dia.} - \text{Root Dia.}}{2} \quad (1)$$

In accordance with the present invention, the depth Ds of the thread profile defining grooves at the starting end of the die will equal twice the penetration Pn as indicated on FIG. 3. This thread profile or groove depth gradually and smoothly increases from the starting end 12 to the point 18 where it reaches the finish form depth Df. As may be seen from FIG. 3, Df does not equal (2)(Pn).

Referring to FIGS. 1 and 2, the die 10 is configured such that the blank will undergo at least 2.5 revolutions between the point 18 and the finish end 14 of the die. The region of the die between point 18 and finish end 14 may be referred to as a dwell region since the thread profile geometry does not change. This dwell region will typically extend approximately one-third of the length of the die.

In accordance with the present invention, the angle of divergence of the facing sides of the grooves in the die varies between an obtuse starting angle $\theta$, which is hereinafter referred to as the pointing form angle, and an acute angle at the beginning of the dwell portion of the die. This transition between the pointing form angle $\theta$ and the finish profile also occurs smoothly and simultaneously with the transition in groove depth from Ds to Df. The pointing form angle $\theta$ will vary as a function of the diameter and pitch of the fastener being formed. Referring again to FIG. 3, the pointing angle $\theta$ may be calculated as follows:

$$\text{Tan} \cdot \alpha = \frac{\text{thread depth at staring end}}{\frac{\text{Pitch} - .008}{2}} \quad (2)$$

Thus, it may be seen that the pointing form angle $\theta$ is:

$$\theta = 180^\circ - (2)(\alpha). \quad (3)$$

Figure 4:
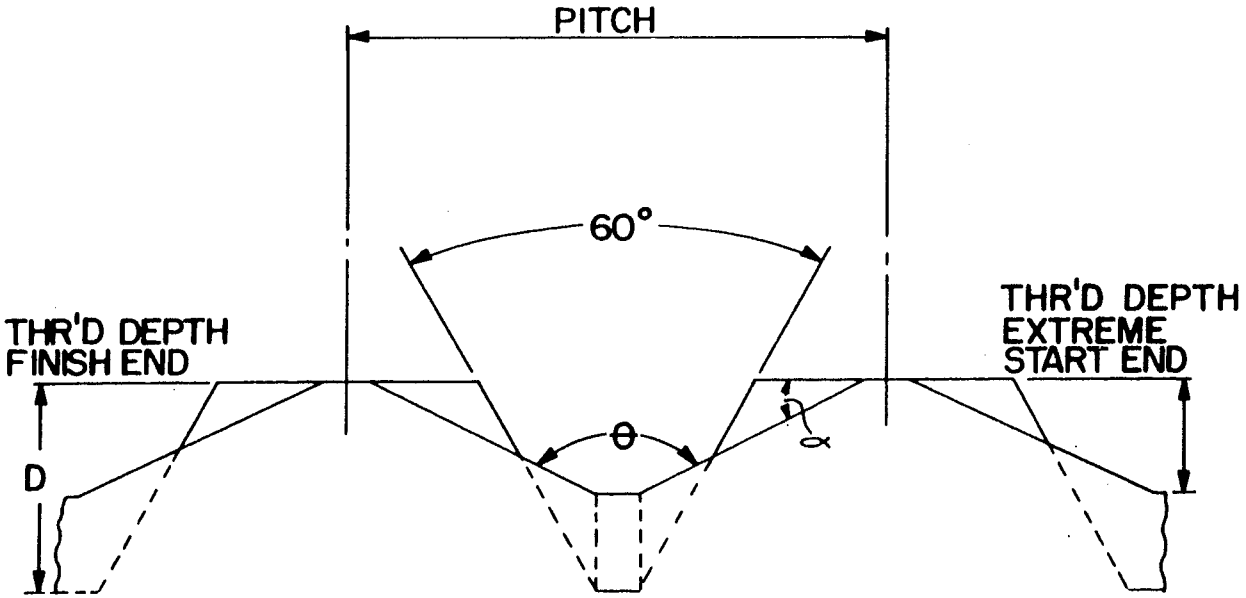
FIG. 4 is a partial end view, taken along line A-A of FIG. 2, which schematically shows a flat die in accordance with the invention on an enlarged scale.
Figure 5E:
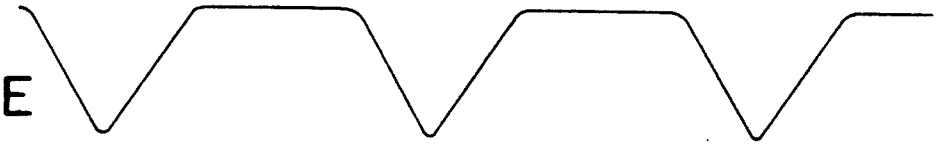
FIGS. 5A–5E are representations of the thread profile cross-section of the die of FIGS. 1–4 at five points along the length of the die.
Figure 5D:
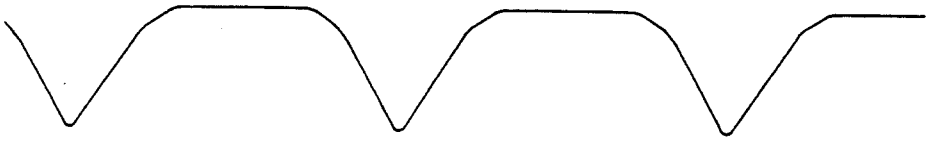
Figure 5C:
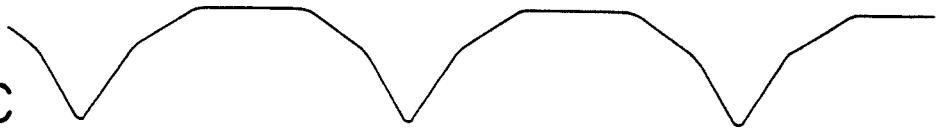
Figure 5B:
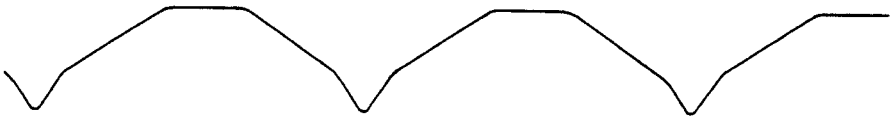
Figure 5A:
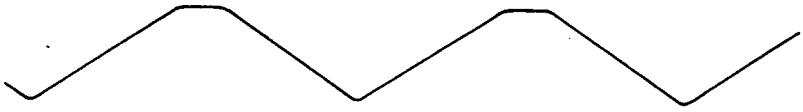

FIG. 4 is a view of a thread rolling die in accordance with the present invention taken in direction A—A of FIG. 2, i.e., from the extreme start end. FIG. 4 clearly shows that, proceeding from the starting end of the die, the thread groove depth gradually increases from approximately twice the penetration to the finish depth D while the angle of divergence of the groove side walls gradually undergoes a transition from the pointing form angle $\theta$ to the finish angle which, in the example being disclosed, is 60°. As the angle of divergence decreases, the width of the crest flats increases gradually from an essentially pointed form to the desired thread root width which, as noted, is substantially wider than the crest width in a space type thread. The width of the root of the die thread profile remains constant along the length of the die.

It will be understood by those skilled in the art that FIGS. 2 and 3 constitute a theoretical or idealized depiction. In actual practice, the crest and roots of the die profile are not flat, as depicted in FIGS. 3 and 4, but are actually rounded as shown in FIG. 5. FIG. 5, proceeding from bottom to top, depicts on an enlarged scale the actual thread profile at the start and finish ends of the die and at three intermediate points along the die. Curves 5*a*–5*e* may respectively be considered to be cross-sectional views taken along lines A—A, B—B, C—C, D—D and E—E of FIG. 2. FIG. 5 clearly shows the smooth transition of the thread form between the starting end of the die and the desired final thread form. FIG. 5 also shows that, as this transition occurs, the groove profile has a double form, i.e., as the thread depth increases the angle of divergence of the facing sidewalls of the grooves decreases. As a cylindrical metal blank passes between a pair of flat dies which embody the invention, and a thread is thus formed therein, the metal comprising the blank will flow in such a manner that the crest of each thread is formed smoothly by a balanced radial flow of material whereby crest seams and craters are avoided.

While the present invention has been described in connection with what is presently considered to be the most practical and preferred embodiment, it is to be understood that the invention is not limited to the disclosed embodiment, but rather is intended to cover various modifications and equivalents included within the spirit and scope of the appended claims. Thus, while the invention has been described as embodied in a flat rolling die, it will be understood by those skilled in the art that the novel thread profile geometry is applicable to cylindrical and planetary dies. Accordingly, the invention has been described above by way of illustration and not limitation.

What is claimed is:

1. In a die for use in the formation of helical thread in a metal blank, the die being provided with plural substantially parallel thread forming grooves in a face thereof which contacts the blank, the grooves having a root portion and being defined by a pair of opposite side walls which diverge from the root portion to a crest portion which is disposed between adjacent grooves, an improved thread profile defining groove geometry comprising:

a dwell portion wherein the depth of the grooves is substantially constant, said dwell portion terminating at the discharge end of the grooves, the groove defining side walls diverging at an average acute angle which is commensurate with the finish form of the thread within said dwell portion, said swell portion extending from the discharge end of the grooves toward the starting end of the grooves a distance which corresponds at least to 2.5 revolutions of the blank and;

a second portion which extends from the starting end of the grooves to said dwell portion, the depth of the grooves increasing progressively and smoothly between said starting end and dwell portion, said side walls diverging at said starting end in accordance with a pointing form angle which exceeds 90°, said side walls undergoing a smooth transition from said pointing form angel to said acute finish form angle along that portion of the grooves where the depth thereof is increasing, said transition progressing outward from said root portions of said grooves toward said crest portions of the die whereby said side walls have a form which smoothly varies in two parameters in the portion of the length thereof disposed between said groove starting ends and said dwell portion.

2. The article of claim 1 wherein said die is a flat thread rolling die.

3. The article of claim 1 wherein said pointing form angle at said groove starting ends is a function of the diameter and pitch of the thread being formed.

4. The article of claim 1 wherein the groove depth at the starting end thereof equals twice the penetration of the metal blank into the die at the said starting end.

5. The article of claim 2 wherein said pointing from angle at said groove starting ends is a function of the diameter and pitch of the thread being formed.

6. The article of claim 5 wherein the groove depth at the starting end thereof equals twice the penetration of the metal blank into the die at the said starting end.

7. The article of claim 6 wherein the die cooperates with a second matching die and each of the dies has a plurality of said grooves, rolling motion being imparted to a blank by causing one of the dies to move linearly with respect to the other die.

8. In a method of forming a threaded fastener by causing deformation of a metal blank, the metal blank being simultaneously subjected to compressive and rotational forces by at least a first die, the die having a blank contacting face which is provided with thread profile defining grooves, the forces applied to the blank causing the metal comprising the blank to be displaced as a function of the die groove geometry, the improvement comprising:

smoothly and progressively increasing the depth of grooves formed in the surface of the blank between a starting depth and a finish depth, the formed grooves each having a root region and oppositely facing flanks which diverge outwardly from the root region;

initially causing the oppositely facing flanks of the grooves formed in the blank to diverge from the root regions of the grooves at a pointing form angle which is greater than 90°;

causing the angle of divergence of said groove flanks to smoothly and progressively decrease to an acute angle commensurate with the desired thread form during the time the depth of the grooves is increasing; and causing the blank to undergo at least two and one-half revolutions while remaining in contact with the die after the die thread profile defining groove has evolved to the finish thread depth and form.

9. The method of claim 8 wherein the depth of the thread profile defining grooves is initially twice the depth of penetration of the blank into the die.

10. The method of claim 8 wherein said pointing form angle is a function of the diameter and pitch of the thread to be formed in the blank.

11. The method of claim 9 wherein said pointing form angle is a function of the diameter and pitch of the thread to be formed in the blank.

12. In a method of forming a threaded fastener by causing deformation of a generally cylindrically shaped portion of a metal blank, the metal blank being simultaneously subjected to compressive and rotational forces by at least a first die, the die having a blank contacting face which is provided with at least a first thread profile defining groove, the improvement comprising:

initiating the formation of a groove in the surface of the cylindrical portion of the blank and progressively increasing the depth of said groove;

initially causing the oppositely facing flanks of said groove to diverge from the root of said groove at an obtuse angle which is commensurate with a sharpened thread form; and causing the angle of divergence of said flanks to smoothly change to a second angle commensurate with the desired finish thread form during the time the depth of said groove is increasing, said second angle being an acute angle.

13. The method of claim 12 further comprising the step of:

subjecting the blank to a finish step wherein the groove depth and angle of flank divergence remain constant.

14. The method of claim 12 wherein the applied forces cause the blank to move linearly while rotating.

15. The method of claim 13 wherein the applied forces cause the blank to move linearly while rotating.

* * * * *